US008230803B2

(12) United States Patent
Franks et al.

(10) Patent No.: US 8,230,803 B2
(45) Date of Patent: Jul. 31, 2012

(54) RUNWAY SELECTOR

(76) Inventors: Terry A. Franks, Papillion, NE (US); Keith P. Kepplin, Omaha, NE (US)

( * ) Notice: Subject to any disclaimer, the term of this patent is extended or adjusted under 35 U.S.C. 154(b) by 0 days.

(21) Appl. No.: 12/925,171

(22) Filed: Oct. 15, 2010

(65) Prior Publication Data

US 2012/0090529 A1 Apr. 19, 2012

(51) Int. Cl.
*G09F 11/23* (2006.01)

(52) U.S. Cl. .. 116/320; 116/316; 116/311; 116/DIG. 43

(58) Field of Classification Search ..... 116/201, 116/307, 311, 316, 318, 319, 320, DIG. 43; 33/1 SB, 1 SD, 431
See application file for complete search history.

(56) References Cited

U.S. PATENT DOCUMENTS

| | | | | | |
|---|---|---|---|---|---|
| 1,156,345 | A | * | 10/1915 | Burnap | 116/308 |
| 1,864,416 | A | * | 6/1932 | Conover | 116/318 |
| 2,996,242 | A | * | 8/1961 | Bannister | 235/61 S |
| 3,100,601 | A | * | 8/1963 | Shapiro | 235/61 B |
| 3,373,493 | A | * | 3/1968 | Mcdonald | 33/1 SD |
| 3,497,678 | A | * | 2/1970 | Warner | 235/61 S |
| 3,804,057 | A | * | 4/1974 | Toscan | 116/318 |
| 4,140,077 | A | * | 2/1979 | Eriksson | 116/320 |
| 4,274,204 | A | * | 6/1981 | Self | 33/1 SD |
| 4,686,929 | A | * | 8/1987 | Jensen, Jr. | 116/318 |
| 5,167,076 | A | * | 12/1992 | Sump | 33/431 |
| 5,214,855 | A | * | 6/1993 | Gibbs | 33/1 SD |
| 5,553,387 | A | * | 9/1996 | Newcomb | 33/1 SD |
| 7,152,332 | B1 | * | 12/2006 | Jain et al. | 33/1 SD |
| 7,287,332 | B2 | * | 10/2007 | Dworman | 33/1 SD |

FOREIGN PATENT DOCUMENTS

DE 3832764 A1 * 3/1990

OTHER PUBLICATIONS

The ATIS Wheel, Aircraft Spruce & Specialty Co., 2 pages, as retrieved from their online catalog on Dec. 14, 2010.

* cited by examiner

*Primary Examiner* — R. A. Smith
(74) *Attorney, Agent, or Firm* — Dennis L. Thomte; Thomte Patent Law Office LLC

(57) ABSTRACT

A runway selector is provided for selecting a runway at an airport which does not have traffic control and which has one or more numbered runways. The runway selector includes a first circular scale having azimuth indicia thereon. The runway selector also includes a second circular scale positioned on the first scale and which has runway number indicia thereon. One or more flat strips, which resemble runways, are selectively rotatably mounted over the scales. A wind direction pointer is selectively rotatably mounted over the scales. The runway selector enables a pilot to visually determine the proper runway to use so that the aircraft may land into the wind as closely as possible.

4 Claims, 3 Drawing Sheets

RUNWAY SELECTOR

BACKGROUND OF THE INVENTION

1. Field of the Invention

This invention relates to a runway selector for selecting a runway at an airport and more particularly to a runway selector for selecting a runway at an airport which does not have traffic control and which has one or more numbered runways.

2. Description of the Related Art

When a pilot approaches an airport which has traffic control, the pilot contacts the control tower for landing instructions. A traffic controller will advise the pilot to land on a numbered runway so that the aircraft will land against the wind as closely as possible. Many of the destination airports will be unmanned or unattended by a traffic controller such as a small city airport which may have two or more numbered runways. Further, even some large airports which have numbered runways and traffic control during regular hours do not have traffic control during certain hours.

As the pilot approaches the unattended airport, the pilot will contact Automatic Terminal Information Service (ATIS) to receive recorded information about the wind direction, wind velocity, etc. in the area of the destination airport. The pilot then must mentally determine which numbered runway should be used at the destination airport so that the pilot may land the aircraft as closely into the wind as possible. Such a mental task may be difficult and distracting to the pilot and may result in the pilot landing on the incorrect runway.

SUMMARY OF THE INVENTION

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

A runway selector is provided for selecting a runway at an airport which does not have traffic control. The runway selector comprises a flat support plate or the like having a first circular compass rose scale positioned thereon. The first scale has compass azimuth indicia thereon extending therearound at the periphery thereof which are spaced apart 10 degrees and which are numbered 010 to 360. A second circular scale is positioned within the first scale with the second scale having a smaller diameter than the diameter of the first scale so that the periphery of the second scale is spaced inwardly of the periphery of the first scale and so that the compass azimuth indicia on the first scale are positioned adjacent the periphery of the second scale. The second scale has runway numbering indicia thereon which extend therearound and which are radially aligned with the compass azimuth indicia on the first scale. The azimuth indicia are numbered 1 through 36 with runway number 36 being positioned radially inwardly of azimuth 180, runway number 9 being positioned radially inwardly of azimuth 270, runway number 18 being positioned radially inwardly of azimuth 360 and runway number 27 being positioned radially inwardly of azimuth 090.

A first elongated flat strip, which resembles a runway, having first and second ends, is selectively rotatably mounted, at its center length, about the center of the first scale, whereby the ends thereof may be selectively positioned adjacent appropriate runway numbers. A second elongated, flat strip which also resembles a runway is provided which has first and second ends. The second strip is selectively rotatably mounted at its center length, about the center of the second scale, whereby the ends thereof may be selectively positioned adjacent appropriate runway numbers. A wind direction indicator is selectively rotatably mounted with respect to the scales.

Means is also provided for maintaining the first and second strips in position during flight. Additional flat strips may also be utilized should the destination airport have more than two numbered runways.

The method of using the runway selector is also described.

These and other objects will be apparent to those skilled in the art.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

DESCRIPTION OF THE PREFERRED EMBODIMENT

Figure 1:
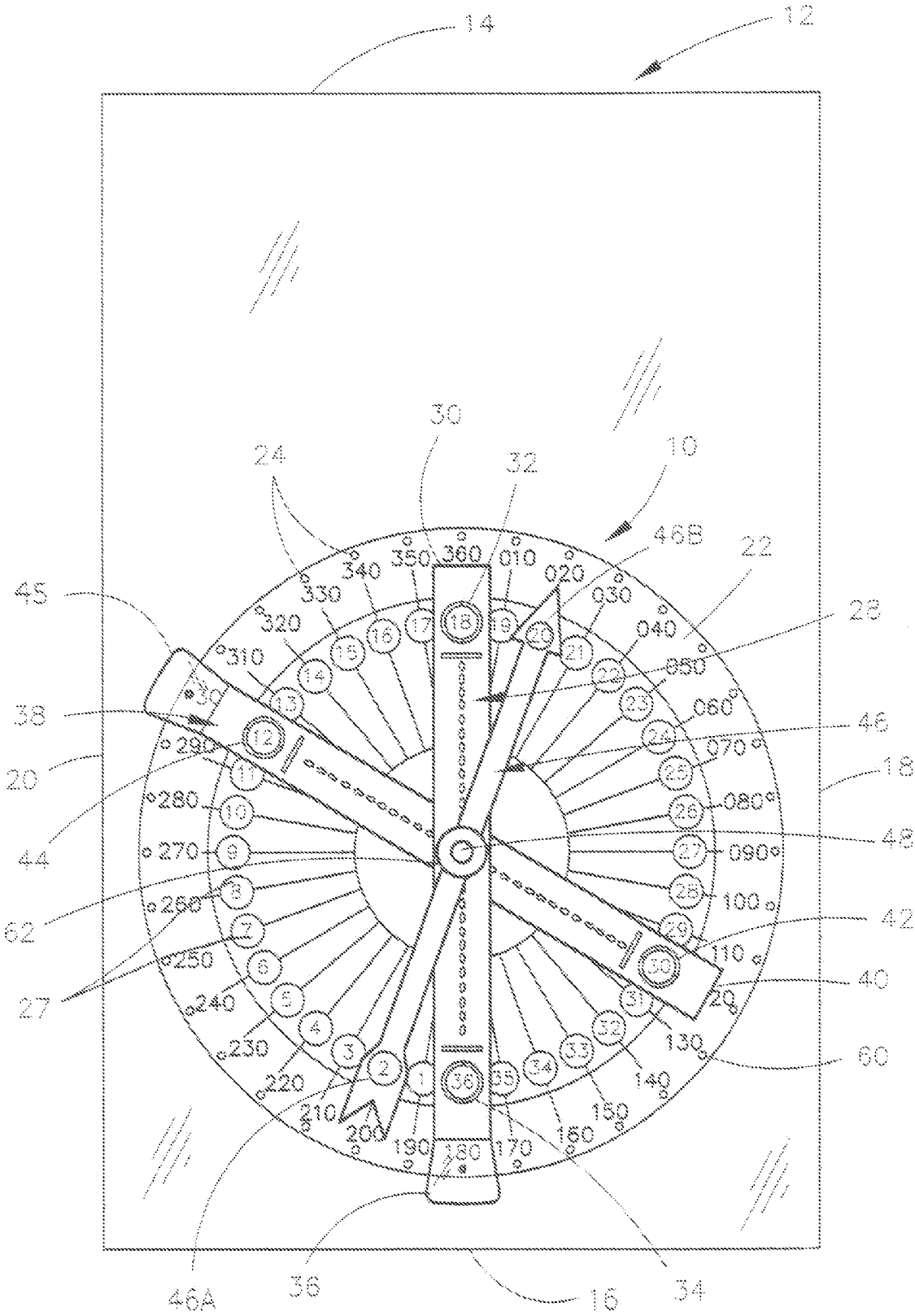
FIG. 1 is a plan view of the runway selector of this invention.
Figure 2:
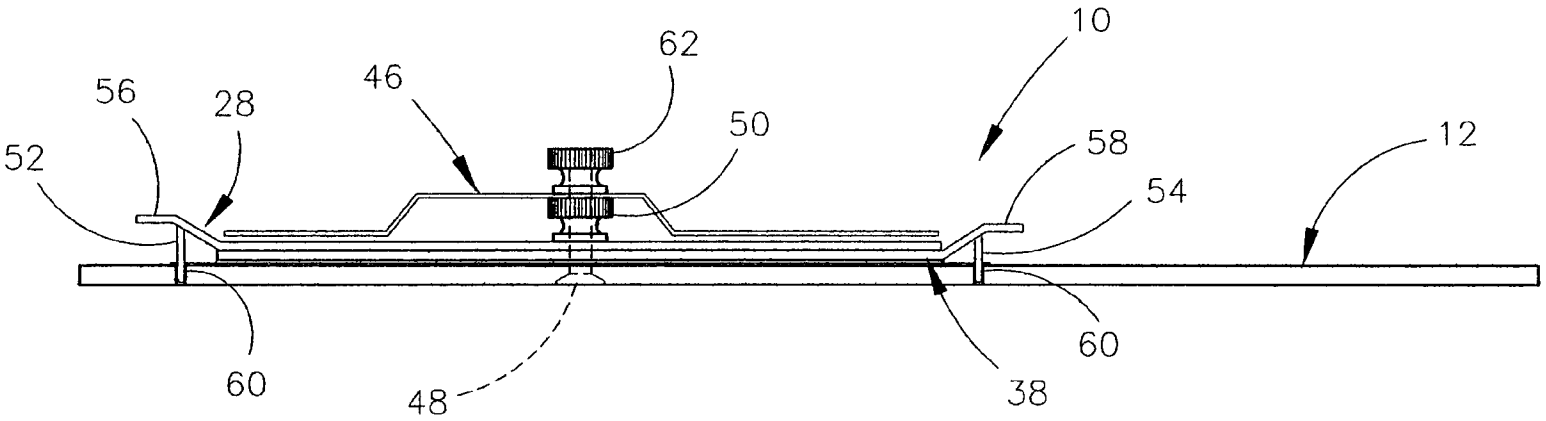
FIG. 2 is a side view of the runway selector of this invention.
Figure 3:
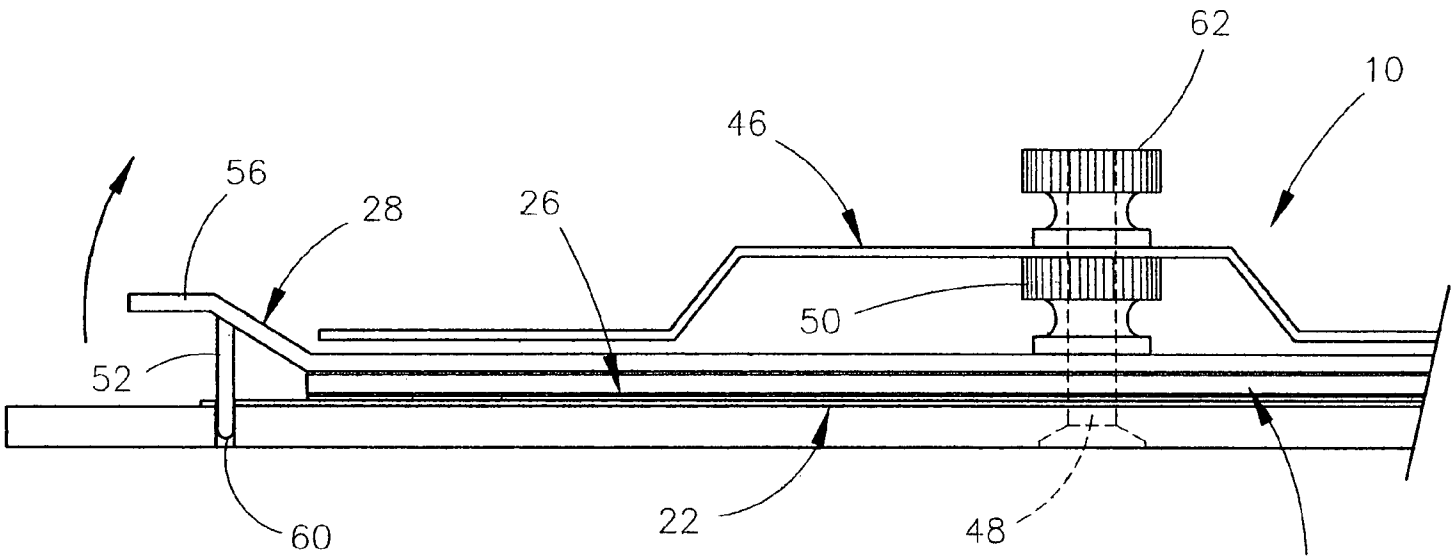
FIG. 3 is an enlarged partial side view of the runway selector of this invention.
Figure 4:
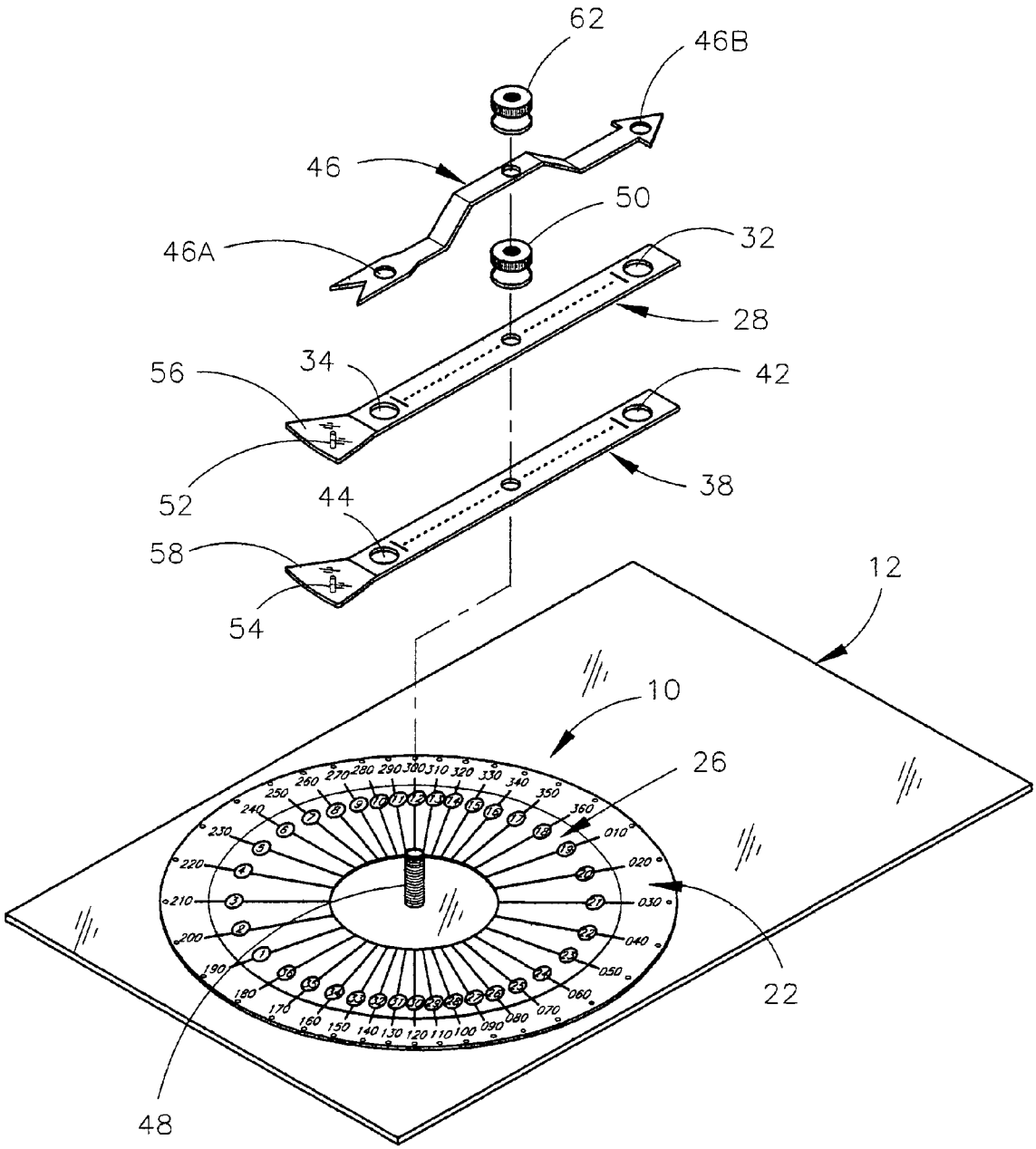
FIG. 4 is an exploded perspective view of the runway selector of this invention.

Embodiments are described more fully below with reference to the accompanying figures, which form a part hereof and show, by way of illustration, specific exemplary embodiments. These embodiments are disclosed in sufficient detail to enable those skilled in the art to practice the invention. However, embodiments may be implemented in many different forms and should not be construed as being limited to the embodiments set forth herein. The following detailed description is, therefore, not to be taken in a limiting sense in that the scope of the present invention is defined only by the appended claims.

The runway selector of this invention is referred to generally by the reference numeral 10. Preferably, the runway selector 10 is preferably mounted on a rigid support plate 12 comprised of a plastic or metal material which may be attached to a pilot's leg or the like in conventional fashion during flight. For purposes of description, support plate 12 will be described as having an upper edge 14, lower edge 16, right edge 18 and left edge 20.

A disc-shaped compass rose or circular scale 22 is mounted on the upper surface of plate 12. Scale 22 has compass azimuth indicia 24 thereon adjacent the periphery thereof which are numbered in ten degree graduations from 010 to 360 with azimuths 360, 090, 180 and 270 referring to magnetic north, east, south and west respectively. A circular scale or disc 26 is positioned within the compass rose 22 and secured thereto and has a smaller diameter than scale 22 as seen in FIG. 1. Scale 26 could be embossed or printed on scale 22. Scales 22 and 26 could also be of single disc construction or of double disc construction. Scale 26 has runway numbering indicia 27 thereon which are aligned with the compass azimuth indicia 24 on scale 20. The indicia 27 are aligned with the indicia 24 so that runway number 1 is aligned with azimuth 190, runway number 9 is aligned with azimuth 270, runway number 18 is aligned with azimuth 360, and runway number 27 is aligned with azimuth 90 and so that runway number 36 is aligned with azimuth 180.

A flat strip 28, which resembles a runway in appearance, is comprised of plastic, metal or paper and is selectively pivoted at its center length to the center of scales 22 and 26. End 30 of strip 28 terminates at the periphery of scale 26 and has a runway number sight window 32 provided therein through which the runway numbers are visible. Strip 28 also has a runway number sight window 34 formed therein inwardly of end 36 thereof.

A flat strip 38, which also resembles a runway in appearance, is comprised of plastic, metal or paper and is also selectively pivoted at its center length to scale 22 and scale 26. End 40 of strip 38 terminates adjacent the periphery of scale 26 and has a runway number sight window 42 provided therein through which the runway numbers are visible. Strip 38 also has a runway number sight window 44 formed therein inwardly of end 45 thereof.

Although two flat strips 28 and 38 are described, the runway selector could include additional flat strips should the destination airport have more than two numbered runways.

A wind direction arrow or pointer 46 is selectively rotatably mounted with respect to scales 22 and 26 to indicate the direction of wind as will be described hereinafter. Pointer 46 has sight windows 46A and 46B formed therein. The strips 28 and 38 may be selectively held in place or position by means of the center pin or bolt 48 extending upwardly from plate 12 and the compression nut 50. Strips 28 and 38 may also be selectively held in place or position by means of the locking pins 52 and 54 which extend downwardly from the flexible and transparent runway thumb tabs 56 and 58 respectively and which are selectively received by the openings 60 formed in scale 22 and plate 12 as seen in the drawings. Pointer 46 may be selectively held in place or position by the compression nut 62.

The runway selector 10 is used as follows. Assuming that the pilot is flying from Omaha to an airport which does not have traffic control, the pilot will check the pilot's charts and determine the runway numbers at the designation airport. For example, if the pilot determines that the runway numbers at the destination airport are 12/30 and 18/36, the pilot will first rotate strip 38 so that the runway numbers 12 and 30 are visible in the runway sight windows 44 and 42 respectively. The pilot will then rotate strip 28 so that the runway numbers 18 and 36 are visible in the runway sight windows 32 and 34 respectively. The strips 28 and 30 are then locked in place so that they will remain in the selected positions during flight.

As the pilot nears the destination airport, the pilot, by radio, will contact Automatic Terminal Information Service (ATIS) to receive information as to wind direction, wind velocity, etc. In this example, if ATIS reports that the wind direction is 200°, the pilot will know that the wind direction is coming from 200°. The pilot will then rotate the wind direction pointer 46 so that the pointer points away from azimuth 200 as seen in FIG. 1. The pilot is then able to quickly visually determine which runway most closely allows the aircraft to be landed against the wind. In this example, the pilot quickly and easily determines that the pilot should land on runway 18 since the orientation of runway 18 is the runway which is most closely into the wind.

Although the invention has been described in language that is specific to certain structures and methodological steps, it is to be understood that the invention defined in the appended claims is not necessarily limited to the specific structures and/or steps described. Rather, the specific aspects and steps are described as forms of implementing the claimed invention. Since many embodiments of the invention can be practiced without departing from the spirit and scope of the invention, the invention resides in the claims hereinafter appended.

The invention claimed is:

1. A runway selector for selecting a runway at an airport which does not have traffic control, comprising:

a flat support plate;

a first circular compass rose scale, having a periphery, positioned on said support plate;

said first scale having compass azimuth indicia thereon extending therearound at said periphery thereof which are spaced apart ten degrees and which are numbered 010 to 360;

a second circular scale, having a periphery, positioned within said first scale having a smaller diameter than the diameter of said first scale so that said periphery of said second scale is spaced inwardly of the periphery of said first scale and so that the compass azimuth indicia on said first scale are positioned adjacent the periphery of said second scale;

said second scale having runway numbering indicia thereon which extend therearound and which are radially aligned with the azimuth indicia on said first scale and which are numbered one through 36 with runway number 36 being positioned radially inwardly of azimuth 180, runway number 9 being positioned radially inwardly of azimuth 270, runway number 18 being positioned radially inwardly of azimuth 360 and runway number 27 being positioned radially inwardly of azimuth 090;

a first, elongated, flat strip having first and second ends;

said first strip being selectively rotatably mounted at its center length, about the center of said second scale, whereby the ends thereof may be positioned adjacent the appropriate runway numbering indicia;

a second elongated, flat strip having first and second ends;

said second strip being selectively rotatably mounted at its center length, about the center of said second scale, whereby the ends thereof may be selectively positioned adjacent the appropriate runway numbering indicia;

and a wind direction indicator selectively rotatably mounted with respect to said scales.

2. The runway selector of claim 1 further including structure to selectively maintain said strips and said wind direction indicator in place with respect to said scales during flight.

3. The runway selector of claim 1 wherein a runway number sight window is provided adjacent each of the ends of said first and second flat strips.

4. A method for selecting a runway at an airport, which does not have traffic control, depending upon the wind direction at that airport, comprising the steps of:

providing a first circular scale having a periphery and compass azimuth indicia thereon which extend therearound at said periphery thereof and which are spaced apart ten degrees and which are numbered 010 to 360;

providing a second circular scale, having a periphery, which has a smaller diameter than the first circular scale and which has runway numbering indicia thereon which extend therearound and which are radially aligned with the azimuth indicia on said first circular scale and which are numbered one through 36 with runway number 36 being positioned radially inwardly of azimuth 180, runway number 9 being positioned radially inwardly of azimuth 270, runway number 18 being positioned radially inwardly of azimuth 360 and runway number 27 being positioned radially inwardly of azimuth 090;

positioning the second circular scale on the first circular scale so that said periphery of the second circular scale is spaced inwardly of said periphery of the first circular scale and so that the compass azimuth indicia on the first circular scale is positioned adjacent said periphery of the second circular scale;

providing a first, elongated, flat strip having first and second ends;

selectively rotatably mounting the first strip about the center of the second circular scale so that the ends thereof are positioned adjacent the runway numbering indicia on the second circular scale;

providing a second, elongated flat strip having first and second ends;

selectively rotatably mounting the second strip about the center of the second circular scale so that the ends thereof are positioned adjacent the appropriate runway numbering indicia on the second circular scale;

providing a wind direction indicator;

rotatably mounting the wind direction indicator over the first and second scales;

determining the runway number of a first runway at the destination airport;

rotating the first strip so that the first strip is aligned with the runway number of the first runway;

determining the runway number of a second runway at the destination airport;

rotating the second strip so that the second strip is aligned with the runway number of the second runway at the destination airport;

establishing radio contact with a source of information regarding the wind direction at the destination airport;

rotating the wind direction indicator so that the wind direction indicator is aligned with the direction of wind at the destination airport;

visually comparing the wind direction indicator to the positions of the first and second strips;

and choosing the runway which is most directly into the wind based on the positions of the first and second strips and the wind direction indicator.

* * * * *